US007631819B2

(12) United States Patent
Shanklin et al.

(10) Patent No.: US 7,631,819 B2
(45) Date of Patent: Dec. 15, 2009

(54) LONGITUDINAL VALVE READY TO USE HOSE END SPRAYER

(75) Inventors: Donald J. Shanklin, Corona, CA (US); Ronald F. Englhard, Dove Canyon, CA (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 424 days.

(21) Appl. No.: 11/068,121

(22) Filed: Feb. 28, 2005

(65) Prior Publication Data

US 2005/0189436 A1 Sep. 1, 2005

Related U.S. Application Data

(60) Provisional application No. 60/548,767, filed on Feb. 27, 2004.

(51) Int. Cl.
*B05B 7/30* (2006.01)

(52) U.S. Cl. ..... 239/318; 239/310; 239/353; 239/414; 239/525; 239/581.1; 137/893

(58) Field of Classification Search ..... 239/310, 239/318, 353, 354, 414, 525, 600, 581.1; 222/630, 637; 137/893, 894

See application file for complete search history.

(56) References Cited

U.S. PATENT DOCUMENTS

| | | | |
|---|---|---|---|
| 667,491 | A | 2/1901 | Brigham |
| 1,813,581 | A | 7/1931 | Rodrigues |
| 2,571,871 | A | 10/1951 | Hayes |
| 2,719,704 | A | 10/1955 | Anderson et al. |
| 2,764,452 | A | 9/1956 | Anderson et al. |
| 2,788,244 | A | 4/1957 | Gilmour |
| 2,837,374 | A | 6/1958 | Lipman |
| 3,064,683 | A | 11/1962 | Nordstrand |
| 3,090,564 | A | 5/1963 | Gilmour |
| 3,122,325 | A | 2/1964 | Mahrt et al. |
| 3,134,545 | A | 5/1964 | Armond |
| 3,180,580 | A | 4/1965 | Schedel |
| 3,186,643 | A | 6/1965 | George et al. |
| 3,207,443 | A | 9/1965 | Gilmour |
| 3,231,200 | A | 1/1966 | Heald |
| 3,254,844 | A | 6/1966 | Blasnik et al. |
| 3,258,026 | A | 6/1966 | Weaver |
| 3,291,395 | A | 12/1966 | Sharp |
| 3,632,083 | A | 1/1972 | Meeks |

(Continued)

*Primary Examiner*—Steven J Ganey

(57) ABSTRACT

A sprayer head assembly comprises a sprayer head and a valve for controlling the flow of fluid through the assembly. The sprayer head comprises a chemical passage, a carrier fluid passage and a vent passage. A generally cylindrical bore is in communication with the chemical, vent carrier fluid passages. The valve is moveably positioned within the bore. The valve is moveable between a first position and a second position. The valve comprises a first passage and a chemical inlet passage that is in communication with the first passage. In the first position, the valve blocks the vent, chemical and carrier fluid passages. In the second position, the first passage is configured to be in communication with the carrier fluid passage while the chemical fluid passage is in communication with the chemical inlet passage. The valve defines a suction generating recess positioned within the first passage. The chemical inlet passage communicates with the first passage through an opening positioned within the suction generating recess. The first passage defines an outlet for discharging the carrier fluid and chemical in a first direction and the valve is rotatable about an axis that extends generally parallel to the first direction.

20 Claims, 28 Drawing Sheets

U.S. PATENT DOCUMENTS

| | | | | |
|---|---|---|---|---|
| 3,764,074 | A | 10/1973 | James | |
| 3,768,777 | A | 10/1973 | Hechler | |
| 3,770,205 | A | 11/1973 | Proctor et al. | |
| 3,809,124 | A | 5/1974 | Nelson | |
| 3,940,069 | A | 2/1976 | Gunzel, Jr. et al. | |
| 4,008,878 | A | 2/1977 | Himmelman | |
| RE29,405 | E | 9/1977 | Gunzel, Jr. et al. | |
| 4,121,773 | A | 10/1978 | Headen et al. | |
| 4,138,033 | A | 2/1979 | Payne et al. | |
| D254,146 | S | 2/1980 | Koenig | |
| 4,281,796 | A | 8/1981 | Fugent et al. | |
| 4,349,157 | A | 9/1982 | Beiswenger et al. | |
| 4,369,921 | A | 1/1983 | Beiswenger et al. | |
| 4,475,689 | A | 10/1984 | Hauger et al. | |
| 4,508,272 | A | 4/1985 | Thompson | |
| 4,595,127 | A | 6/1986 | Stoody | |
| 4,640,461 | A | 2/1987 | Williams | |
| 4,651,930 | A | 3/1987 | Magaha, Jr. | |
| 4,736,891 | A | 4/1988 | Chow et al. | |
| 4,750,674 | A | 6/1988 | Chow et al. | |
| 4,767,058 | A | 8/1988 | LaRosa et al. | |
| 4,785,850 | A * | 11/1988 | Sanchez | 137/894 |
| 4,811,900 | A | 3/1989 | LaRosa et al. | |
| 4,826,085 | A | 5/1989 | Chow et al. | |
| 4,838,490 | A | 6/1989 | Nissels | |
| 4,878,619 | A | 11/1989 | Norman | |
| 4,881,575 | A | 11/1989 | Smith | |
| 4,901,923 | A | 2/1990 | McRoskey et al. | |
| 4,901,976 | A | 2/1990 | Smith | |
| 4,969,603 | A | 11/1990 | Norman | |
| 5,007,588 | A | 4/1991 | Chow et al. | |
| 5,039,016 | A | 8/1991 | Gunzel, Jr. et al. | |
| 5,100,059 | A | 3/1992 | Englhard et al. | |
| 5,152,464 | A | 10/1992 | Farley | |
| 5,213,264 | A | 5/1993 | Styne | |
| 5,213,265 | A | 5/1993 | Englhard et al. | |
| 5,320,288 | A | 6/1994 | Ketcham, Jr. | |
| 5,356,076 | A | 10/1994 | Bishop | |
| 5,372,310 | A | 12/1994 | Ketcham | |
| 5,383,603 | A | 1/1995 | Englhard et al. | |
| D358,865 | S | 5/1995 | Englhard et al. | |
| 5,595,345 | A | 1/1997 | Chura et al. | |
| 5,649,664 | A | 7/1997 | Brass et al. | |
| 5,655,563 | A | 8/1997 | Johnson | |
| 5,850,973 | A | 12/1998 | Liljeqvist et al. | |
| 5,945,160 | A | 8/1999 | Kobak et al. | |
| 5,954,272 | A | 9/1999 | Liao | |
| D433,095 | S | 10/2000 | Beauer et al. | |
| 6,267,304 | B1 | 7/2001 | Schultz | |
| D451,581 | S | 12/2001 | Shanklin et al. | |
| 6,345,773 | B1 | 2/2002 | Shanklin et al. | |
| 6,378,785 | B1 | 4/2002 | Dodd | |
| 6,425,534 | B2 | 7/2002 | Ketcham et al. | |
| 6,471,141 | B2 | 10/2002 | Smith et al. | |
| 6,578,776 | B1 | 6/2003 | Shanklin et al. | |
| 6,651,901 | B2 | 11/2003 | Jones | |
| D484,572 | S | 12/2003 | Shanklin et al. | |
| 6,655,660 | B2 | 12/2003 | Wales | |
| 6,672,520 | B2 | 1/2004 | Shanklin et al. | |
| 6,726,123 | B2 | 4/2004 | Wang | |
| 6,749,133 | B1 | 6/2004 | Ketcham et al. | |
| 6,772,966 | B2 | 8/2004 | Foster et al. | |
| 7,063,277 | B2 * | 6/2006 | Englhard et al. | 239/354 |
| 2004/0118944 | A1 | 6/2004 | Amaduzzi | |
| 2004/0124263 | A1 | 7/2004 | Seeman | |
| 2004/0140372 | A1 | 7/2004 | Englhard et al. | |

* cited by examiner

LONGITUDINAL VALVE READY TO USE HOSE END SPRAYER

PRIORITY INFORMATION

This application claims the priority benefit under 35 U.S.C. § 119(e) of Provisional Application 60/548,767 filed Feb. 27, 2004, the entire contents of this application are hereby incorporated by reference herein.

BACKGROUND OF THE INVENTION

1. Field of the Invention

The present invention relates to chemical dispensing sprayers and, in particular, to aspiration-type sprayers that use a relatively large amount of carrier fluid for dispensing a relatively small amount of a chemical solution.

2. Description of the Related Art

Every year consumers apply thousands of gallons of chemicals such as fertilizers or pesticides to plants, lawns, flowers, vegetable gardens and other organic type vegetation. Typically, such chemicals are sold in plastic containers in a concentrated form. While in this concentrated form, the chemical is extremely hazardous to the consumer end user and the environment in general. Accordingly, the container typically includes an aspiration-type sprayer head assembly. An aspiration-type sprayer uses a relatively large amount of carrier fluid, such as water, to withdraw, dilute and dispense a relatively small amount of chemical from the container. To further prevent harm to the consumer, the container and the sprayer head assembly are preferably disposed of after the container's contents are exhausted. It is therefore desirable to provide a sprayer head assembly that is sufficiently low cost so as to allow the entire unit to be discarded and yet reliable and safe.

In some applications, it is desirable to use a sprayer head assembly to selectively apply the chemical/carrier mixture and the carrier fluid to a surface. For example, the chemical/carrier mixture may form a cleaning solution, which is rinsed away by the carrier fluid. Such a sprayer head-assembly is particularly useful for cleaning surfaces that cannot be physically reached by the user but can be reached by the spray generated by the sprayer head assembly. U.S. Pat. No. 5,595,345 describes one such sprayer head assembly. However, this sprayer assembly includes a relatively large number of parts and is difficult to manufacture and to assemble. U.S. Pat. No. 3,940,069 describes a sprayer head assembly that is capable of forming two different ratios of a chemical/carrier fluid mixture. However, this sprayer head assembly also includes a relatively large number of parts and is difficult to manufacture and assemble.

SUMMARY OF THE INVENTION

It is therefore an object of the invention to provide a safe and reliable aspiration type chemical sprayer that utilizes a minimum number of components and that is relatively easy to manufacture and assemble. By reducing the number of components, inventory costs can be greatly reduced. It is also desirable that most of the parts can be made from injection molded plastic, which is relatively inexpensive.

Accordingly, one embodiment of the present invention involves a sprayer head assembly that comprises a sprayer valve and a valve for controlling the flow of fluid through the assembly. The sprayer head comprises a chemical passage, a carrier fluid passage and a vent passage. A generally cylindrical bore is in communication with the chemical, vent and carrier fluid passages. The valve is moveably positioned within the bore. The valve is moveable between a first position and a second position. The valve comprises a first passage and a chemical inlet passage that is in communication with the first passage. In the first position, the valve blocks the vent, chemical and carrier fluid passages. In the second position, the first passage is configured to be in communication with the carrier fluid passage while the chemical fluid passage is in communication with the chemical inlet passage. The valve defines a suction generating recess positioned within the first passage. The chemical inlet passage communicates with the first passage through an opening positioned within the suction generating recess. The first passage defines an outlet for discharging the carrier fluid and chemical in a first direction and the valve is rotatable about an axis that extends generally parallel to the first direction.

Another embodiment of the present invention involves a sprayer head assembly that comprises a sprayer valve and a valve for controlling the flow of fluid through the assembly. The sprayer head comprises a chemical passage configured to be in communication with the cavity, a carrier fluid passage configured to be in communication with a carrier fluid source, and a vent passage configured to be in communication with the cavity. A generally cylindrical valve chamber is in communication with the chemical, vent and carrier fluid passages. The valve moveably positioned within the valve chamber between at least a first position, a second position and a third position. The valve comprises a first passage and a chemical inlet passage that is in communication with the first passage. In the first position, the valve blocks the vent, chemical and carrier fluid passages. In the second position, a first opening into the first passage is aligned with an outlet of the carrier fluid passage to place the first passage in communication with the carrier fluid passage while the chemical fluid passage is in communication with the chemical inlet passage. In the third position, a second opening into the first passage is aligned with the outlet of the carrier fluid passage to place the carrier fluid passage in communication with the first passage while the valve blocks the vent and chemical passages.

All of these embodiments are intended to be within the scope of the invention herein disclosed. These and other embodiments of the present invention will become readily apparent to those skilled in the art from the following detailed description of the preferred embodiments having reference to the attached Figures., the invention not being limited to any particular preferred embodiment(s) disclosed.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

BRIEF DESCRIPTION OF THE DRAWINGS

These and other features of the invention will now be described with reference to the drawings of the preferred embodiments, which are intended to illustrate and not to limit the invention, and in which:

FIG. 20 is a cross-sectional view of the sealing pad of FIG. 18;

DETAILED DESCRIPTION OF THE PREFERRED EMBODIMENT

Figure 1:
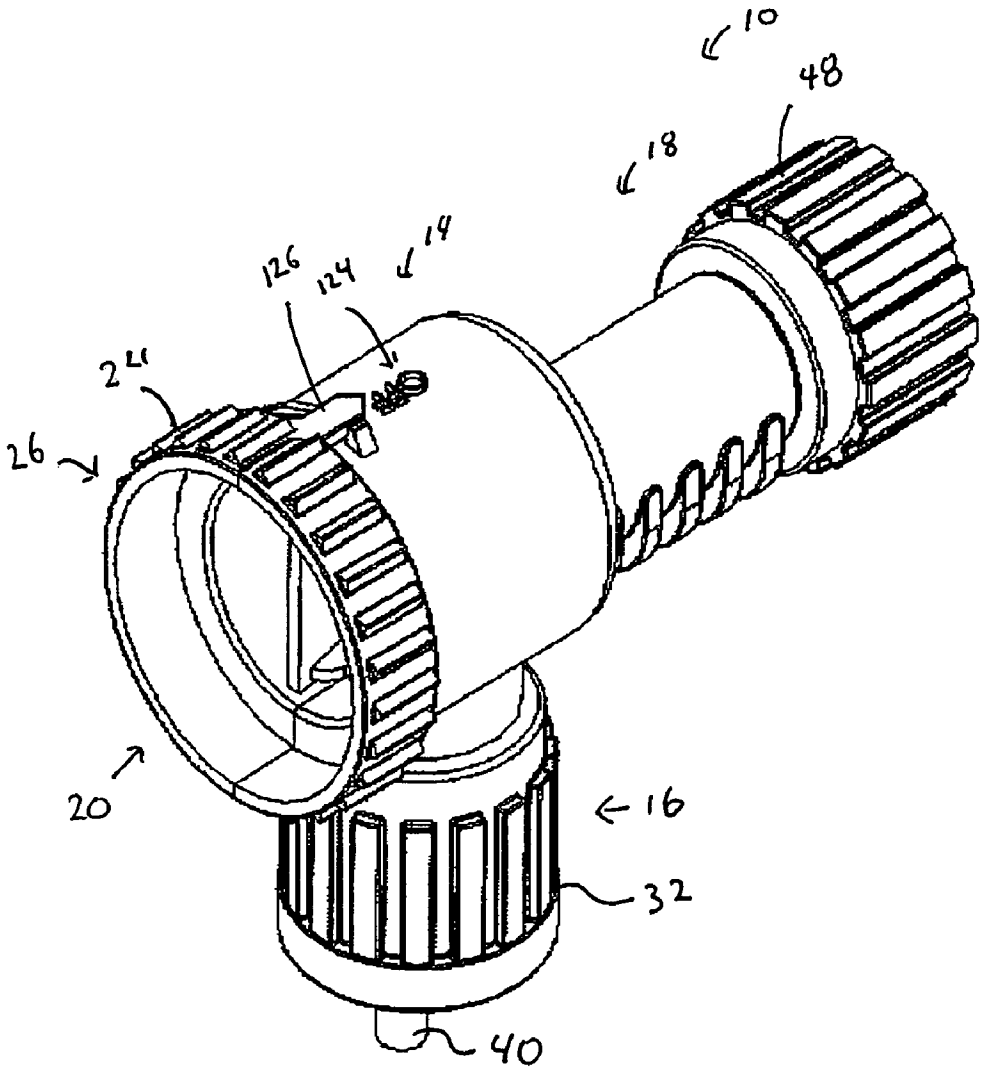
FIG. 1 is a left side perspective view of an embodiment of a sprayer head assembly in an "off" position.
Figure 2:
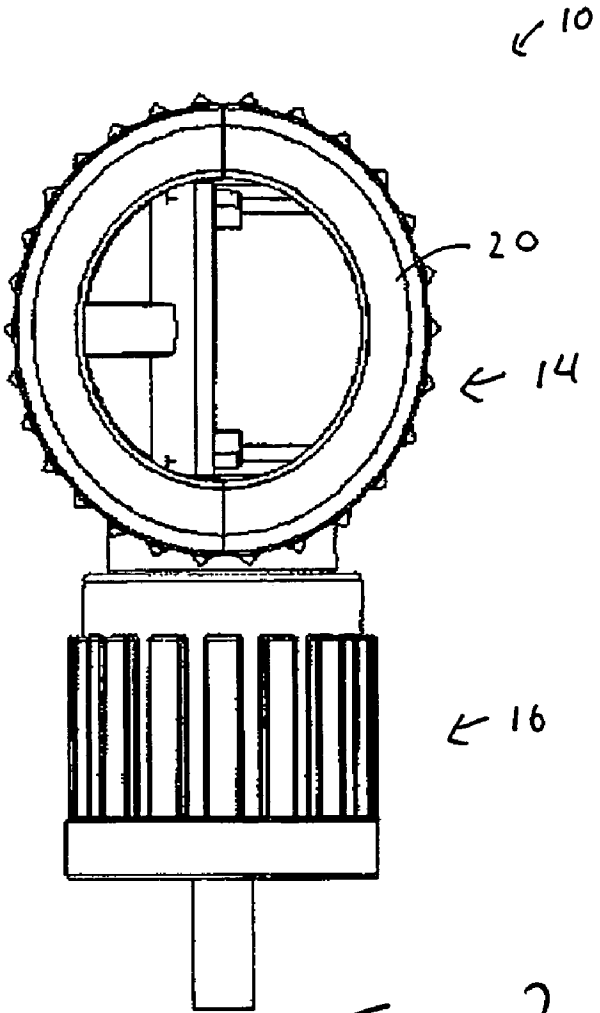
FIG. 2 is a front view of the sprayer head assembly of FIG. 1 in an "off" position.
Figure 3:
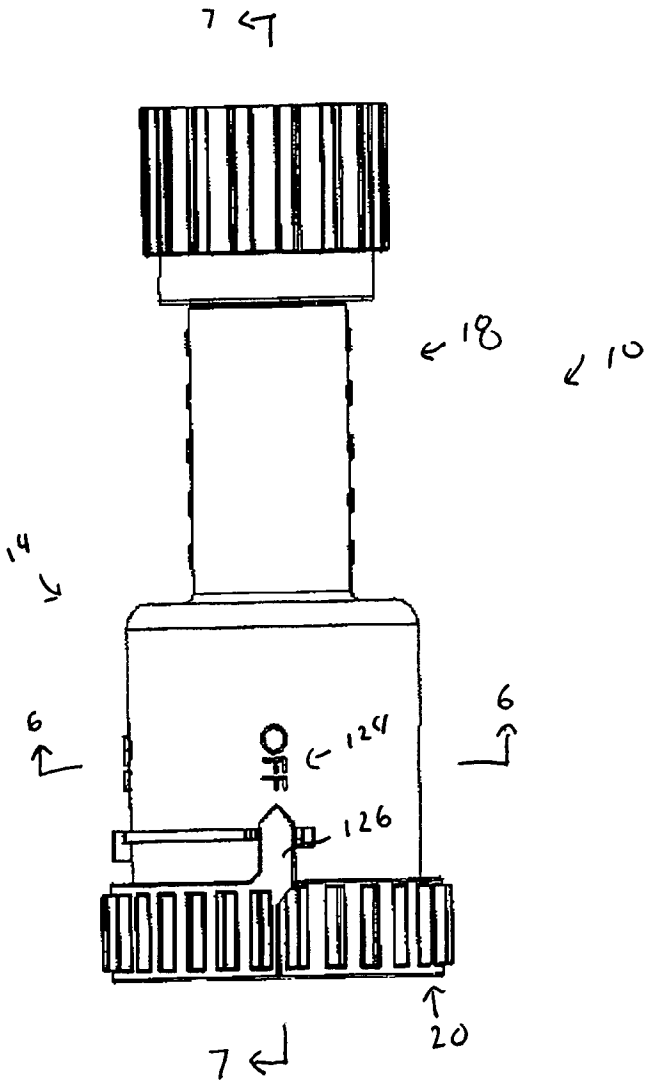
FIG. 3 is a top view of the sprayer head assembly of FIG. 1 in an "off" position.
Figure 4:
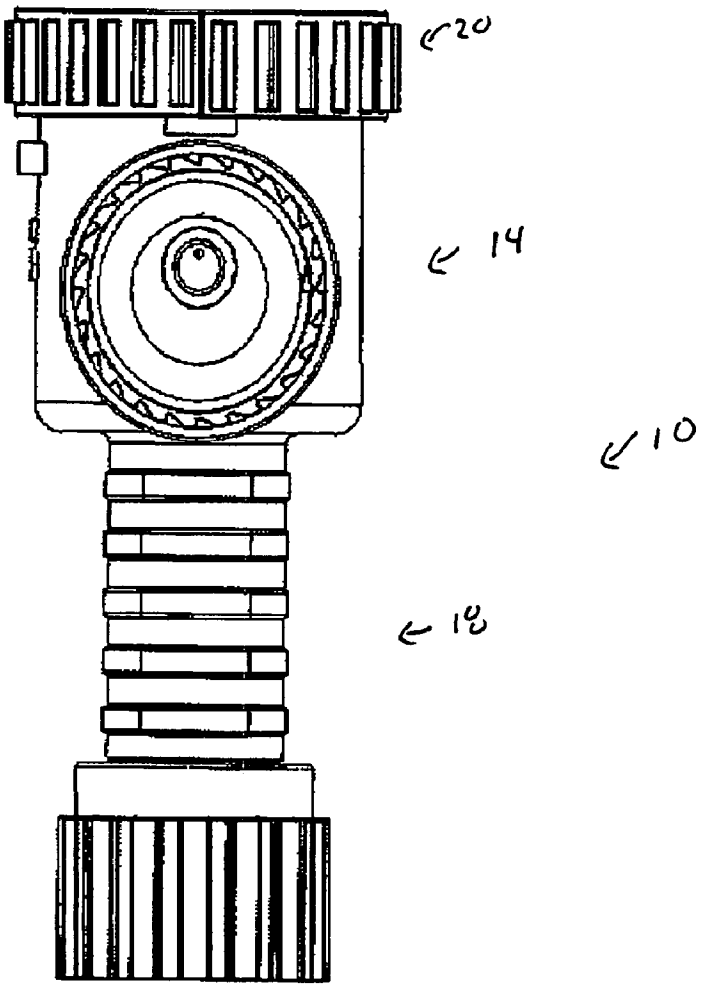
FIG. 4 is a bottom view of the sprayer head assembly of FIG. 1 in an "off" position.
Figure 5:
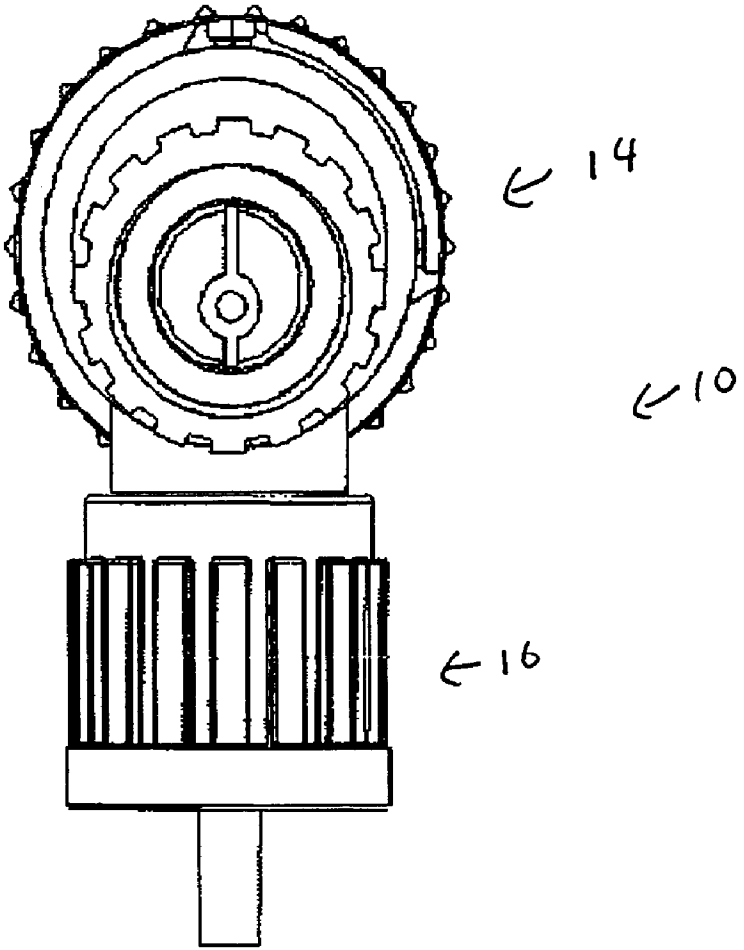
FIG. 5 is a rear view of the sprayer head assembly of FIG. 1 in an "off" position.

A sprayer head assembly 10 according an exemplary embodiment of the present invention is illustrated in FIGS. 1-11. As shown in FIG. 1, the sprayer head assembly 10 includes a sprayer head 14, a container connection portion 16, a supply fluid connection portion 18, and a rotatable control valve 20, which is shown in detail in FIGS. 13-17. The sprayer head assembly 10 may be made of any suitable material that is resistant to and compatible with the chemical fluid to be sprayed. However, a flexible plastic material, such as polypropylene, is preferred because it is resilient yet durable.

Figure 6:
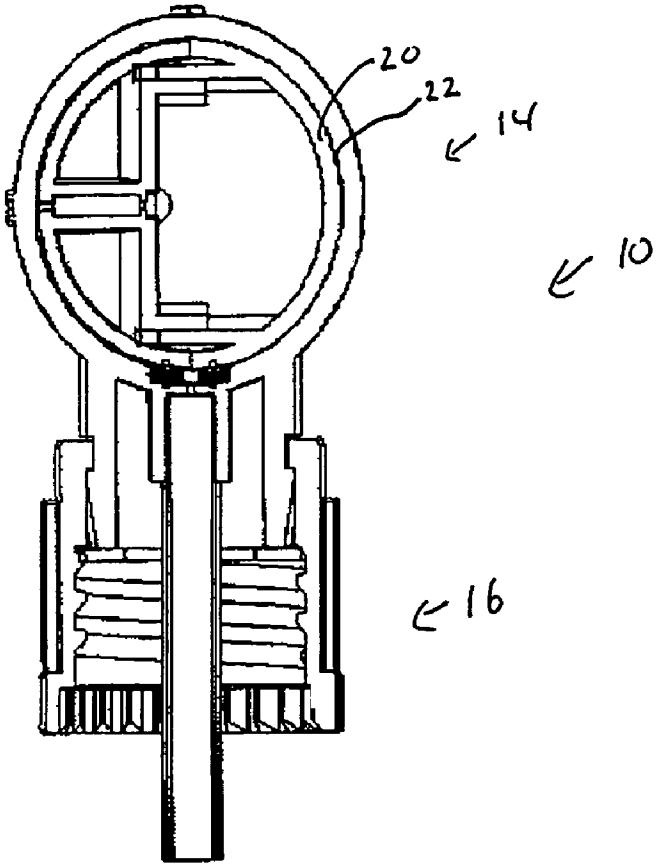
FIG. 6 is a cross-section view of the sprayer head assembly taken along line 6-6 of FIG. 3.
Figure 7:
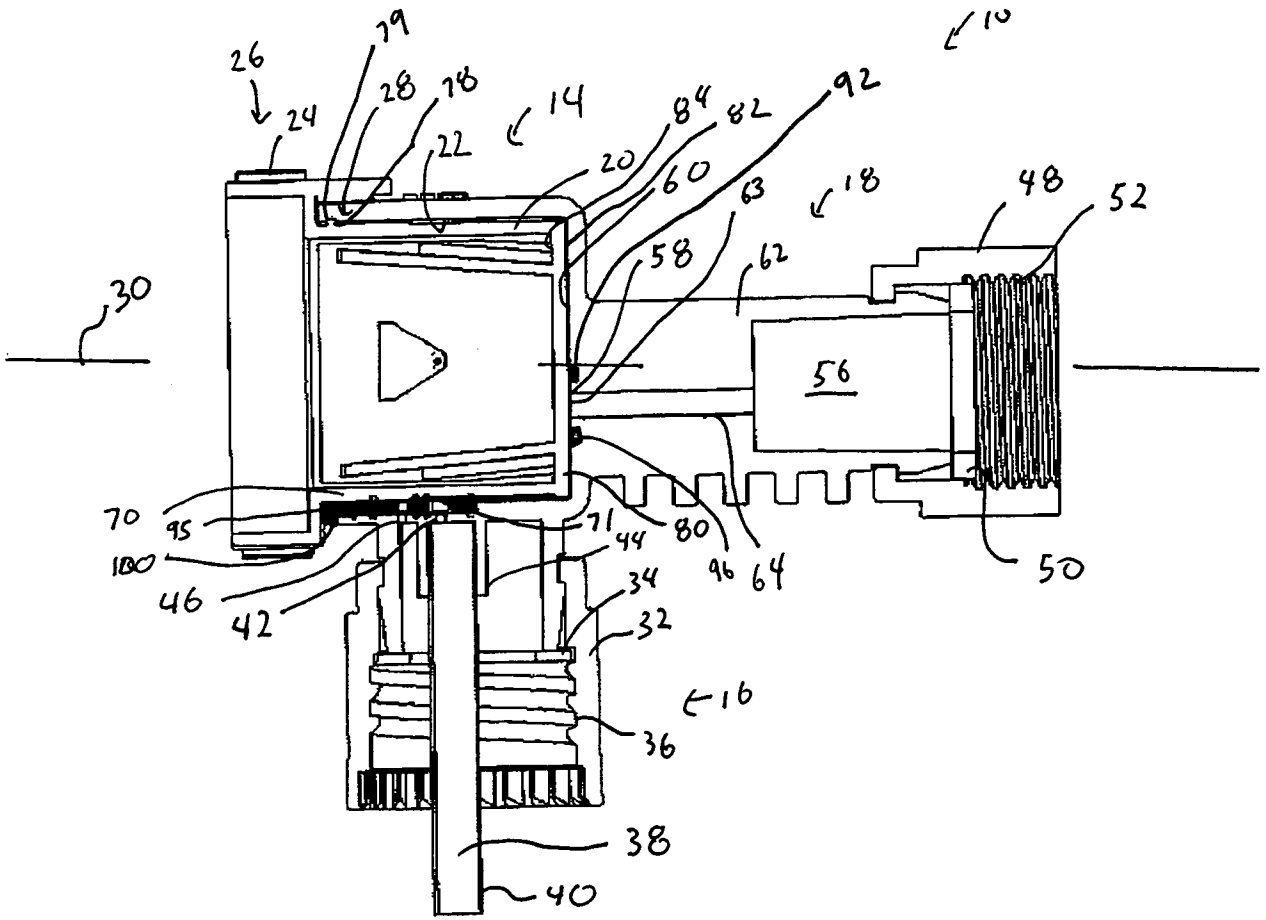
FIG. 7 is a cross-section view of the sprayer head assembly taken along line 7-7 of FIG. 3.
Figure 8:
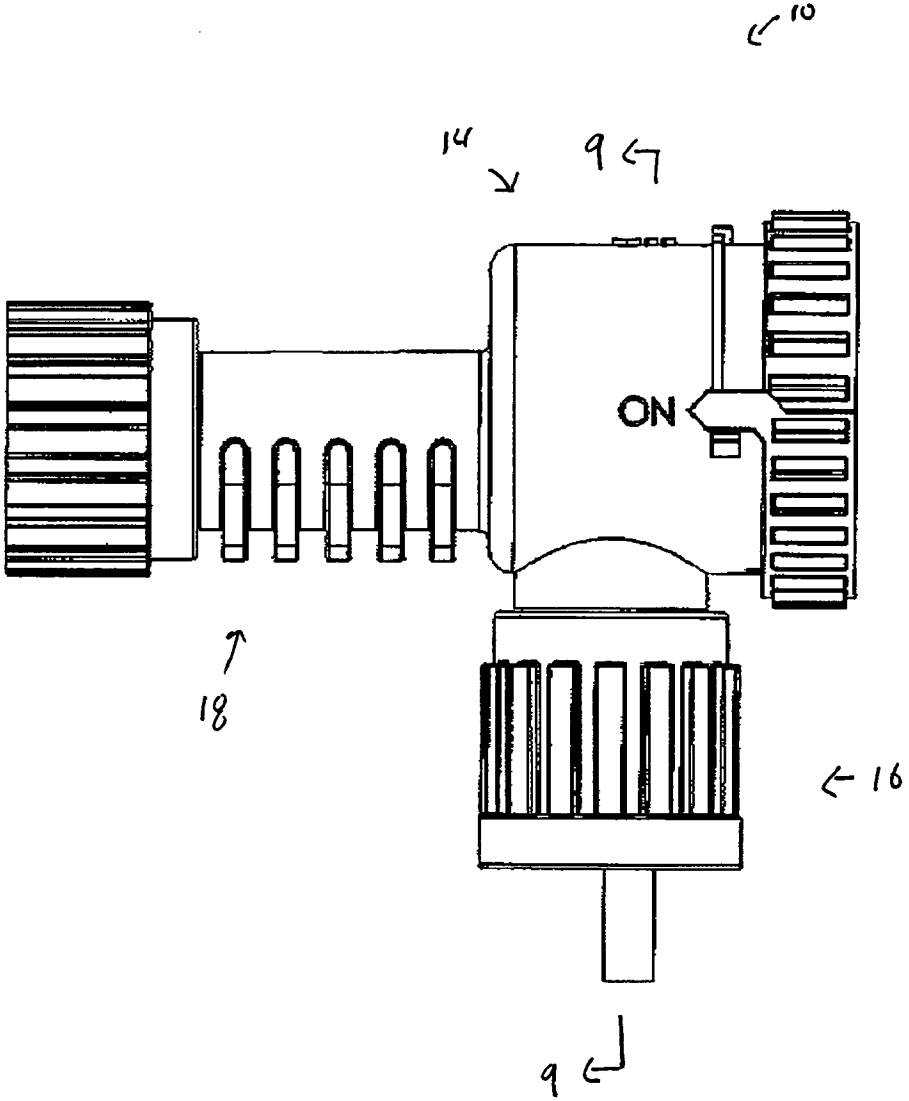
FIG. 8 is a right side view of the sprayer head assembly of FIG. 1 in an "on" position.

With reference to FIGS. 1, 6 and 7, the valve 20 is at least partially positioned in a bore or valve chamber 22 that is formed in the sprayer head 14 of the sprayer head assembly 10. The bore or valve chamber 22 preferably has a generally cylindrical shape. The valve 20 includes a gripping area 24 that is preferably part of a distal end 26 of the valve 20, which, when the valve 20 is inserted into the cylindrical bore 22, extends distally past a distal end 28 of the cylindrical bore 22. As will be explained in more detail below, an operator may move the valve 20 between at least two positions (e.g., "off", and "on") by gripping the gripping area 24 and rotating the valve 20 within the cylindrical bore 22. In a modified embodiment (see FIGS. 21-26), the valve 20 is moveable between at least three positions (e.g., "off" "on" and "water only").

The valve 20, bore 22, and gripping area 24 are illustrated as being arranged substantially about a longitudinal axis 30 (see FIG. 7) of the sprayer head 14. The longitudinal axis 30, in turn, extends generally in the same direction as the fluid 30*a* (see FIG. 10) discharged from the sprayer 10. This longitudinal arrangement of the valve 20, bore 22, and gripping area 24 is preferred because it allows the operator to rotate the valve 20 in an ergonomical position. That is, the operator can hold the container in one hand and rotate the valve 20 with the other hand without excessive rotation and lifting of the elbows and shoulders. However, those of ordinary skill in the art will recognize that some of the aspects of the described embodiments may be achieved with the valve 20 arranged along a non-longitudinal axis. The construction the valve 20 and bore 22 will be described in more detail below.

With continued reference FIGS. 1 and 7, the connection between the sprayer head assembly 10 and the container can be achieved by providing the container connection portion 16 with a conventional rotatable coupler 32 and a washer 34. The rotatable coupler 32 includes internal threads 36 that cooperate with corresponding threads (not shown) formed on the neck of the container.

The sprayer head assembly 10 can also be permanently attached to the container. In such an arrangement, adhesive can be applied to the inner surface of the connection portion 16 before it is fitted over the neck of the container. Alternatively, the connection portion 16 can include an inwardly projecting ratchet that opposes a cooperating ratchet formed on the container.

With particular reference to FIG. 7, when the sprayer head assembly 10 is installed onto the container, the interior of the container is in communication with a chemical passage 38 that is also in communication with the interior of the cylindrical bore 22. In the illustrated arrangement, the chemical passage 38 is defined in part by a downwardly depending chemical flow tube or dip tube 40. The dip tube 40 extends into the container and preferably terminates near a bottom surface of the container. The chemical passage 38 is also defined in part by an internal passage 42, which is formed in the sprayer head 14. The internal passage 42 communicates with the interior of the cylindrical bore 22 and the dip tube 40. The dip tube 40 is secured in fluid communication with the internal passage 42 by a cylindrical boss 44. Although, in the illustrated arrangement the chemical passage 38 is defined by two components (the dip tube 40 and the internal passage 42), it should be appreciated that the chemical passage 38 can be defined by a single component or more than two components. For example, the dip tube 40 may be integrally formed with the sprayer head 14. The illustrated arrangement, however, is preferred because it is easy to manufacture and yet uses a small number of components. It should also be appreciated that in the illustrated arrangement the chemical passage 38 defines a flow path that is generally perpendicular to the longitudinal axis 30 of the sprayer 10.

Figure 12:
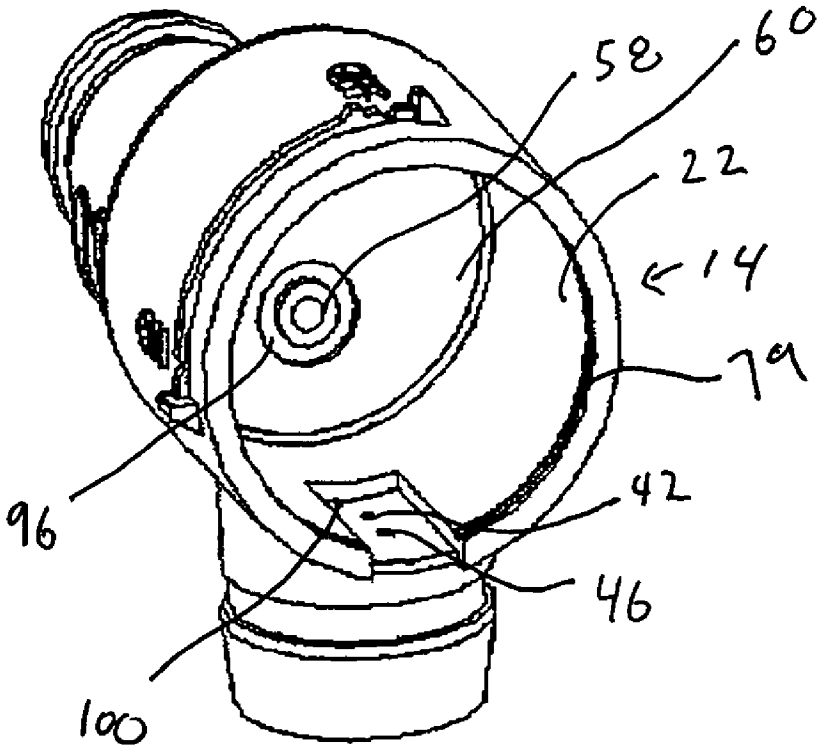
FIG. 12 is a front perspective view of a body of the sprayer head assembly of FIG. 1.

Preferably, the sprayer head assembly 10 includes a vent passage 46, which is best seen in FIG. 7 and in FIG. 12. In the illustrated arrangement, the vent passage 46 is formed in the head 14 of the assembly 10. As with the chemical passage 38, the vent passage 46 communicates with the interior of the container when the assembly 10 is mounted onto the container. The vent passage 46 extends up through head 14 and communicates with the interior of the cylindrical bore 22. The vent passage 46 lies generally parallel to (and spaced along the axis 30 of the valve 20 from) the internal passage 38. Although, in the illustrated arrangement the vent passage 46 is formed on the assembly 10, it should be appreciated that the vent can be located on the container. However, the illustrated arrangement is preferred because, as will be explained below, it enables the vent passage 46 to be opened and closed by the valve 20.

With continued reference to FIG. 7, the sprayer head assembly 10 also includes the carrier fluid connection portion 18. The carrier fluid connection portion 18 connects the assembly 10 to a pressurized carrier fluid source (not shown), such as, for example, a garden hose. In the illustrated arrangement, the connection is formed by a conventional rotatable coupler 48 and a washer 50. The coupler 48 includes threads 52 that cooperate with corresponding threads (not shown) formed on the supply fluid source. One of ordinary skill in the art will appreciate that other configurations can be used to connect the assembly 10 to the carrier fluid source.

The carrier fluid connection portion 18 defines, at least in part, a carrier fluid passage 56. The carrier fluid passage 56 is in communication with the carrier fluid source and the interior of the bore 22 through an opening 58 formed by an end wall 60 of the bore 22 (see also FIG. 12). In the illustrated arrangement, the supply passage 56 is defined in part by a side wall 62, which extends from the end wall 60 to the coupler 48 of the sprayer head 14. The supply passage 56 preferably includes an elongated constriction portion 64, which in the preferred embodiment directly communicates with the cylindrical bore 22. The elongated constriction passage 64 helps to produce a uniform, non-turbulent stream of carrier fluid into the bore 22. It should be appreciated that the supply passage 56 can be defined by a single component or more than two components, which can be integrated together or made separately. The illustrated arrangement is preferred because it is relatively simple to form and produces the desired uniform stream of carrier fluid. It should also be appreciated that the opening 58 defines a carrier fluid axis that is generally parallel to the longitudinal axis 30 of the sprayer 10.

Figure 11:
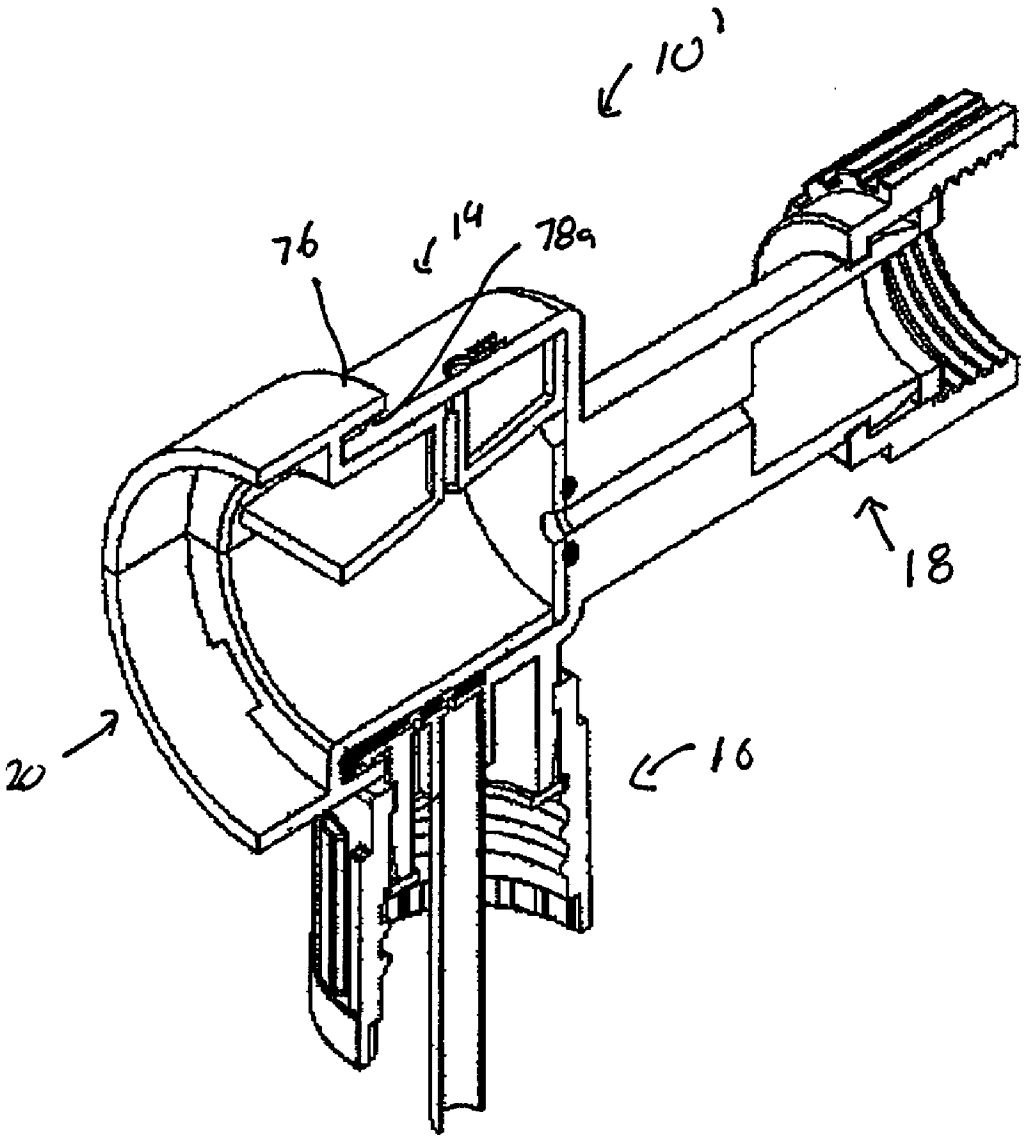
FIG. 11 illustrates cross-sectional perspective view of a modified embodiment of the assembly of FIG. 1.

As best seen in FIGS. 7 and 13-17, in the illustrated arrangement, the valve 20 comprises a generally cylindrical side wall 70, which defines a outer surface 72 for rotative engagement with the cylindrical bore 22 and an inner surface 74. The wall 70 includes an annular ridge 78, which engages a corresponding annular groove 79 (see also FIG. 12). The ridge 78 secures the valve 20 axially within the bore 22. In one embodiment, the valve 20 is inserted into the sprayer head 14 by inserting the valve 20 into the inner bore 22 until the ridge 78 engages the groove 79 in a snap fit. Once snap-fitted, the valve 20 can rotate within the cylindrical bore 22 and is secured axially by the engagement of the annular ridge 78 with the groove 79. FIG. 11 illustrates a modified embodiment of the assembly 10' wherein the valve 20 includes one or more tabs 76 which extend around the distal end of the housing 14. The tabs 76 engage a ridge **78*a* a on the housing to secure the valve 20 in the inner bore 22. Accordingly, the valve 20 can be inserted into the sprayer head 14 by snap-fitting the valve 20 over the annular ridge 78*a* a. Once snap-fitted, the valve 20 can rotate within the cylindrical bore 22 but is secured axially by the engagement of the annular ridge 78*a***.

With continued reference to FIGS. 12-17, the valve 20 includes a proximal end wall 80, which lies adjacent or near the end wall 60 of the cylindrical bore 22. The end wall 80 includes outer and inner surfaces 82, 84. In the illustrated embodiment, the valve 20 comprises a bottom portion 20A (FIGS. 13-15) and a 20B top portion (FIGS. 16-17), which are coupled together to form the valve 20 shown in FIGS. 1-11. Of course, in modified embodiments, the valve 20 can be formed from a single member or more than two members.

As best seen in FIG. 7, in the "closed" position, the proximal end wall 80 of the valve 20 forms a sealing portion 63, which blocks the opening 58 of the carrier fluid passage 56. The sealing portion 63 may be formed in several different manners. For example, the sealing portion 63 can be formed from a separate sealing pad (not shown) that is positioned within a recess formed on the valve 20. As such, the sealing pad moves with the valve 20 as it is moved from the open to closed positions. The sealing pad in such an embodiment is preferably made of a soft plastic elastomer material or other suitable synthetic rubber material. In the illustrated embodiment, a sealing member 92 is positioned in an annular recess 96 (see also FIG. 12) provided around the carrier fluid opening 58. The sealing member 92 is preferably made of a soft plastic elastomer material and is configured to form a tight seal to prevent leakage of carrier fluid between the valve 20 and the inner bore 22. Other arrangements for providing a tight seal between the valve 20 and the inner bore 22 include but are not limited coating the valve 20 and/or inner bore 22 with an elastic material or other suitable material and/or providing sealing member(s) that are integrally formed with the valve 20 and/or inner bore 22. In yet another embodiment, the valve 20 and inner bore can be formed without sealing members or elastic material.

Figure 18:
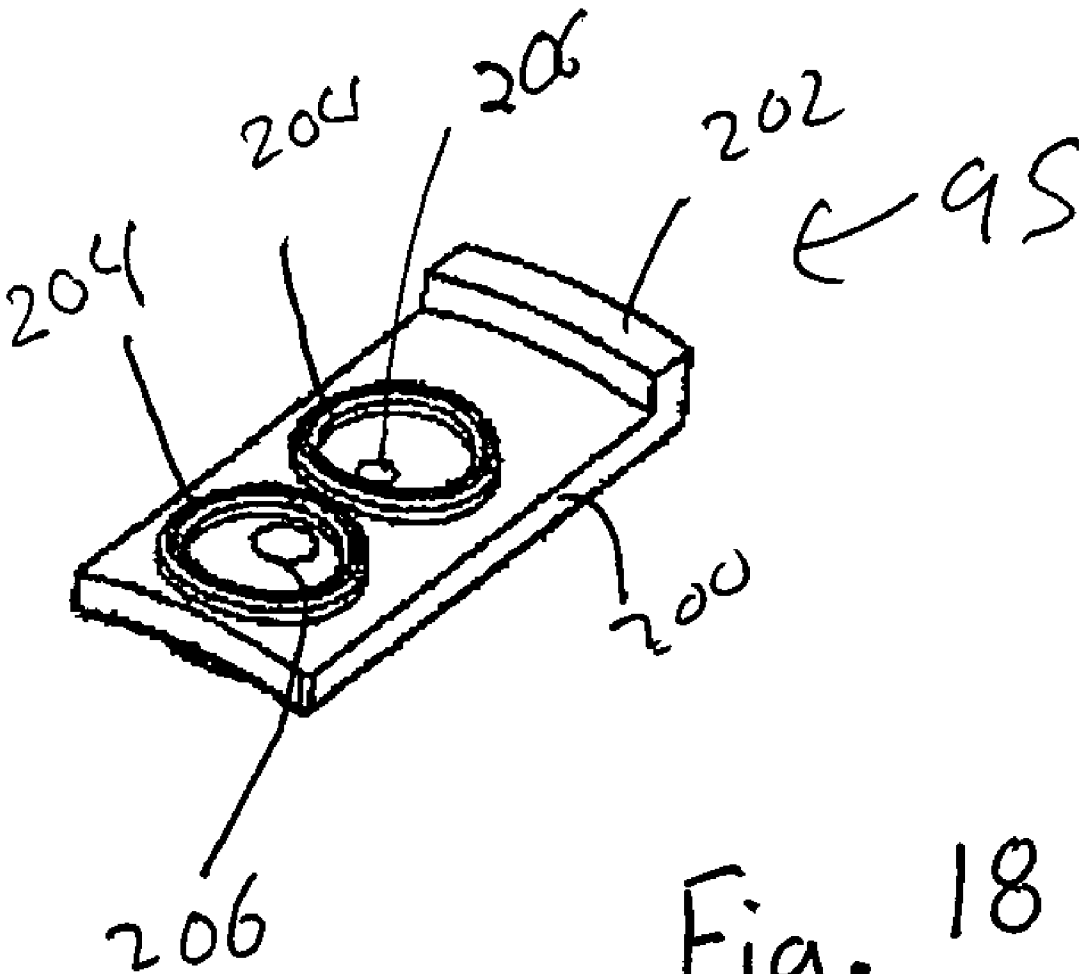
FIG. 18 is a bottom view of a sealing pad of the assembly of FIG. 1.
Figure 19:
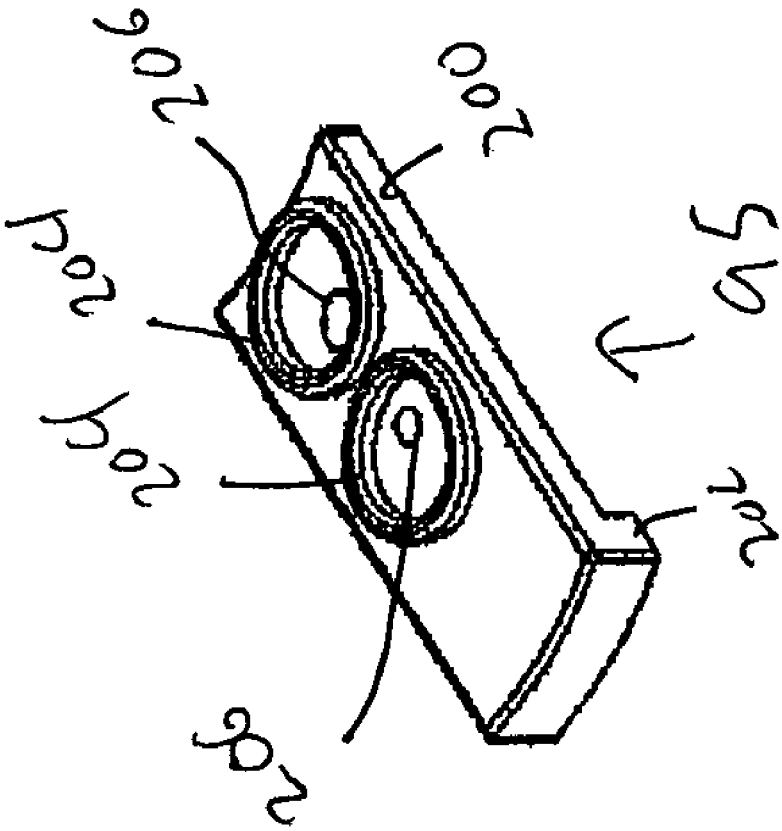
FIG. 19 is a top view of the sealing pad of FIG. 18.
Figure 28D:
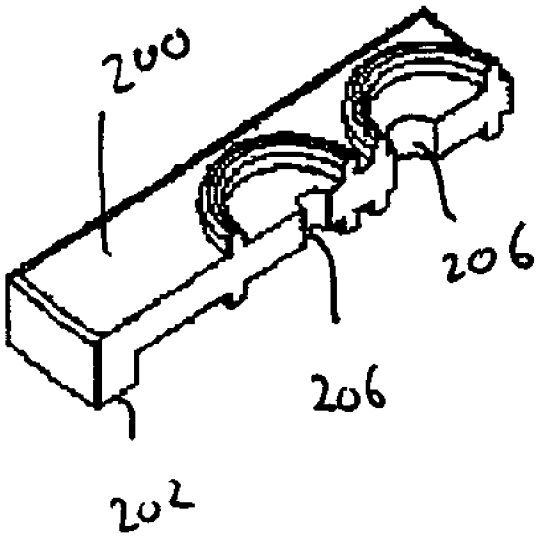
FIG. 28 is a bottom view of the bottom half of the valve of FIG. 27.
Figure 21:
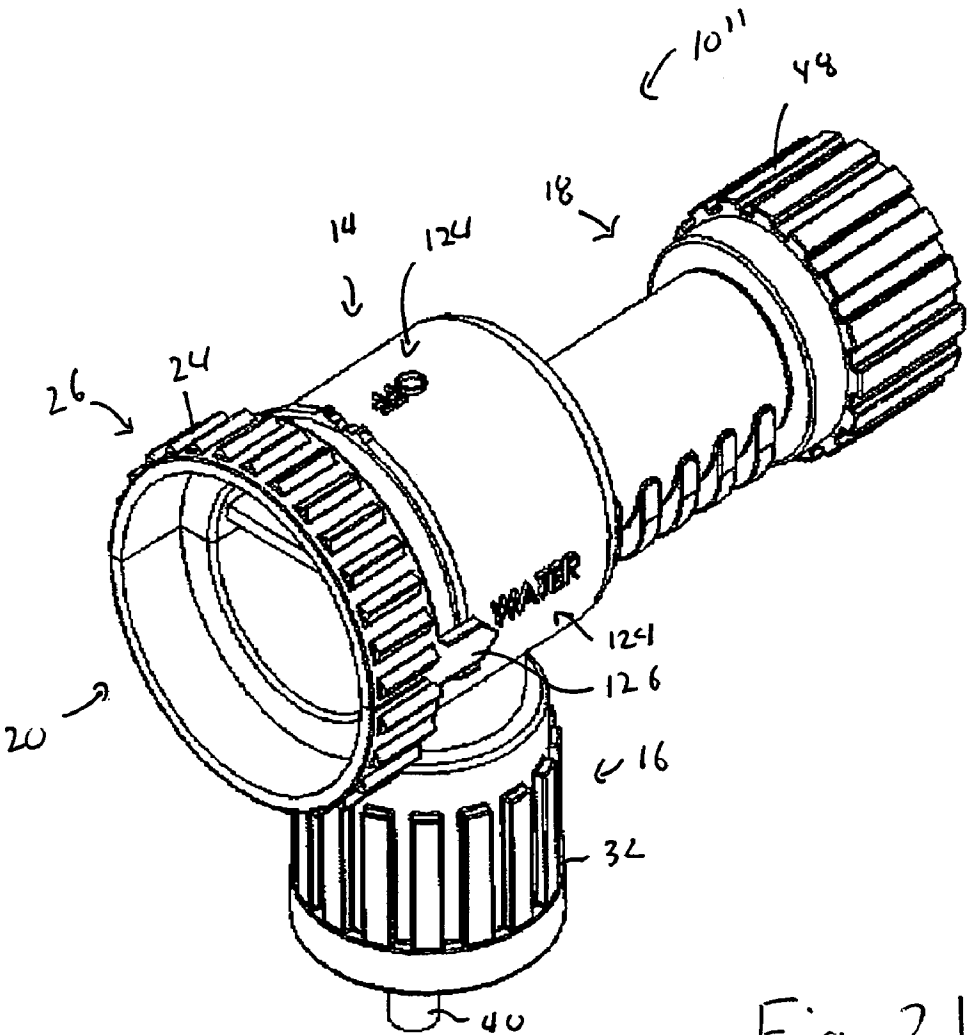
FIG. 21 is a side perspective view of a modified sprayer head assembly of FIG. 1 in a "water" position.
Figure 22:
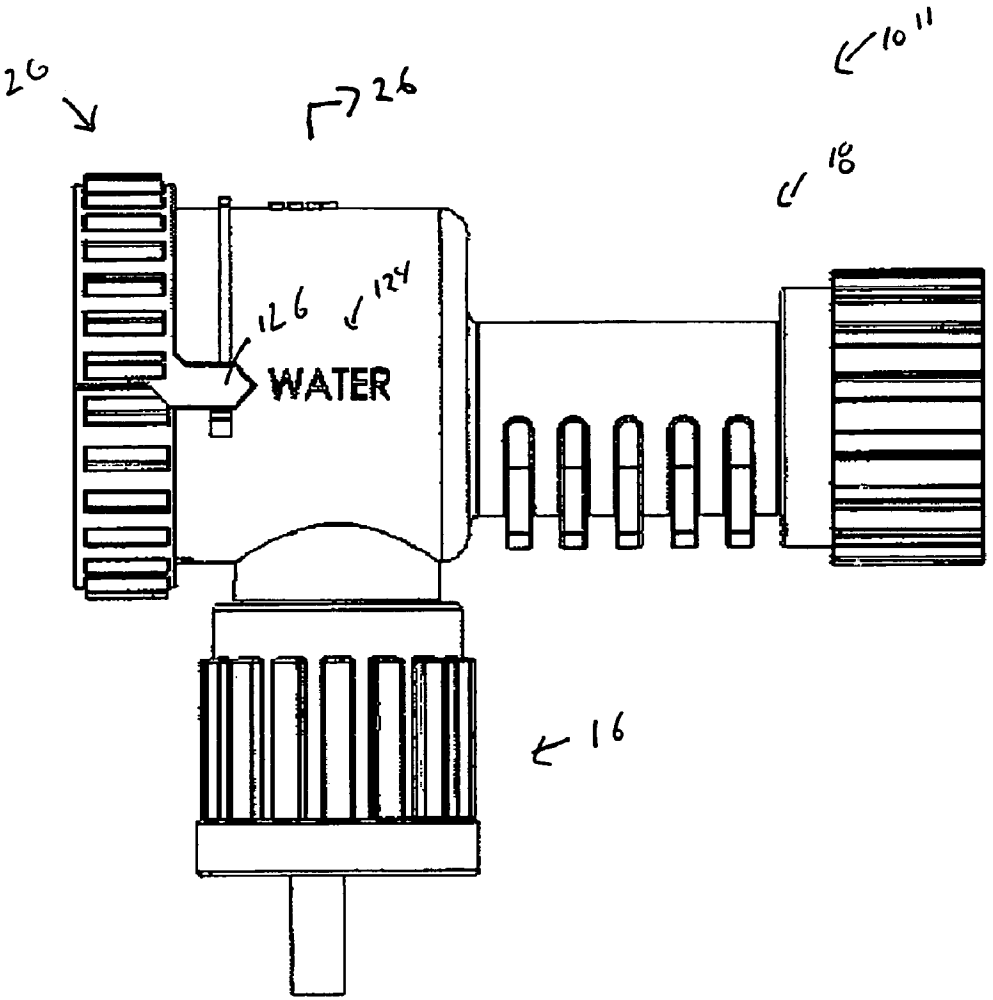
FIG. 22 is a side view of the sprayer head assembly of FIG. 21.
Figure 23:
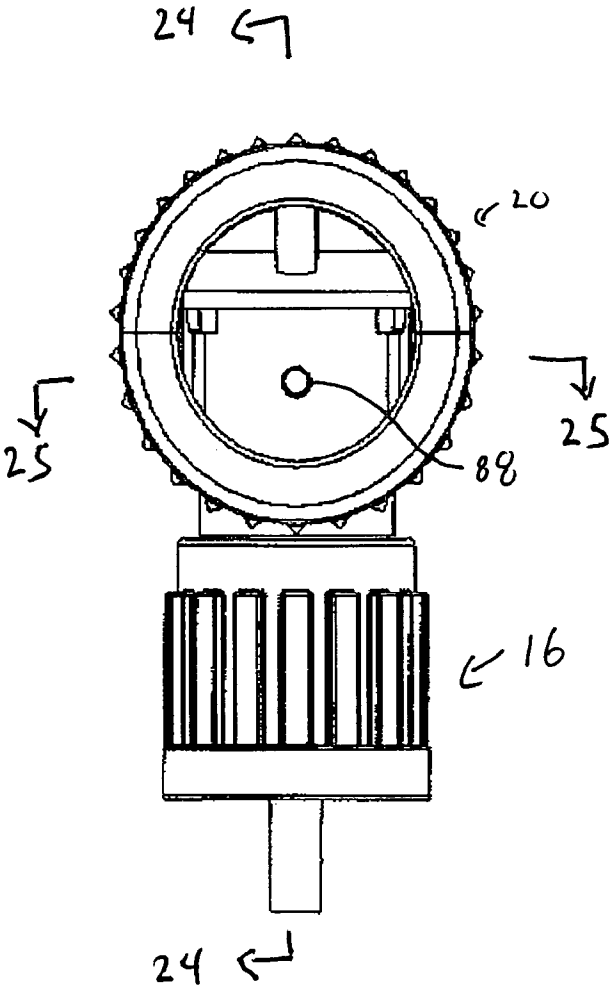
FIG. 23 is a front view of the sprayer head assembly of FIG. 21.
Figure 24:
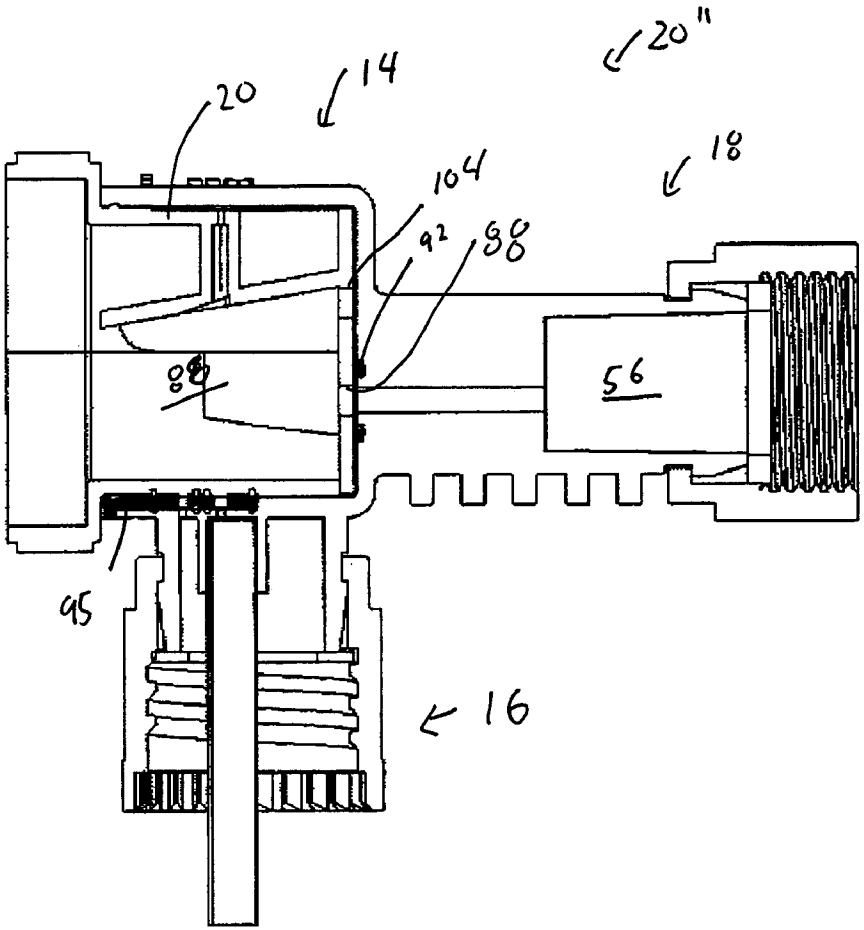
FIG. 24 is a cross-sectional view taken through line 24-24 of FIG. 23.
Figure 25:
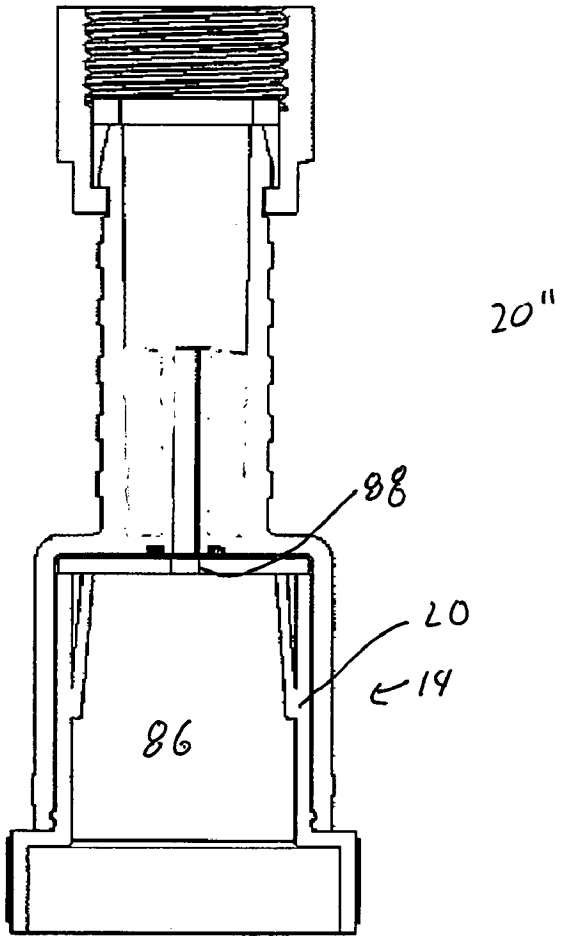
FIG. 25 is a cross-sectional view taken through line 25-25 of FIG. 23.
Figure 26:
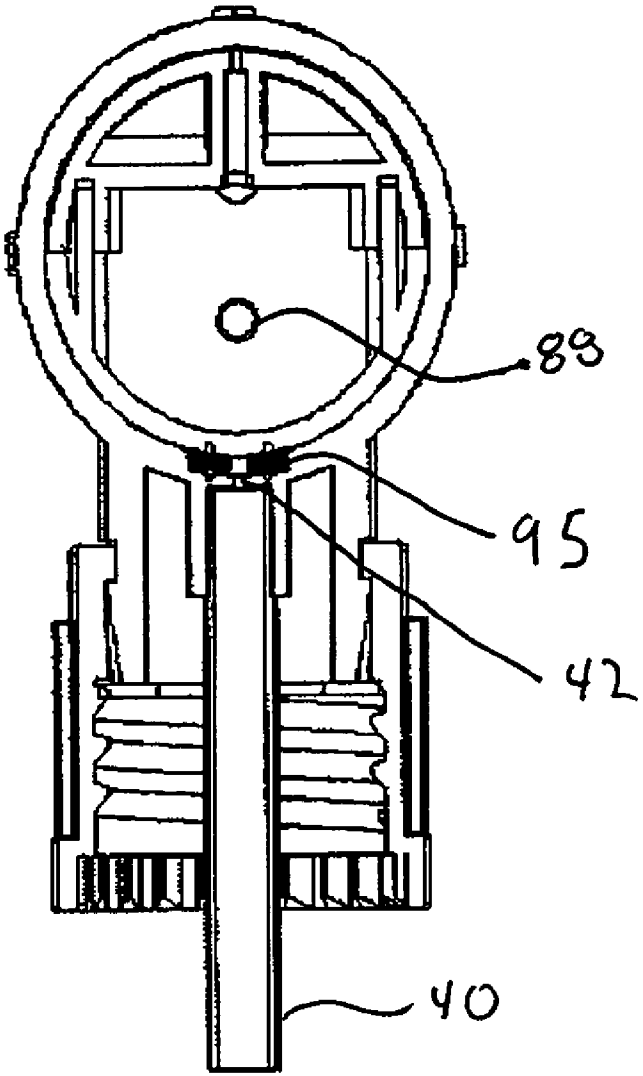
FIG. 26 is a cross-sectional view taken through line 26-26 of FIG. 22.

With continued reference to FIG. 7, the side wall 70 of the valve 20 includes a sealing portion 71 that blocks the chemical passage 42 and the vent passage 46 when the valve 20 is in the off position. In the illustrated embodiment, the assembly includes a second sealing member 95, which is positioned within a corresponding recess 100 (see FIG. 12) formed on the inner bore 22 and will be described in more detail below. The second sealing member 95 is also preferably made of a soft plastic elastomer material and is configured to form tight seal to prevent leakage of chemical into the inner bore 22. With particular reference to FIGS. 18-20, in the illustrated embodiment, the sealing member 95 comprises a body 200 with a flange 202 that is configured to extend outside the bore 22 (see e.g. FIG. 7). Both sides of the body 200 include annular ridges 204 that surround passages 206 that are configured to align with the chemical and vent passages 42, 46. Of course, in modified embodiments the sealing member 95 may have other configurations or be divided into multiple parts. For example, in one embodiment, the sealing member 95 may be replaced with a pair of O-rings or the annular ridges removed. As with the carrier fluid passage 56, other arrangements for providing a tight seal between the valve 20 and the inner bore 22 include but are not limited coating the valve 20 and/or inner bore 22 with an elastic material or other suitable material and/or providing sealing member(s) that are integrally formed with the valve 20 and/or inner bore 22. In yet another embodiment, the valve 20 and inner bore can be formed without sealing members or elastic material to block the chemical and vent passages 42, 46 in the closed position.

With reference back to FIG. 7, in the off or closed position, the carrier passage 56, chemical passage 42 and the vent passage 46 are all closed by the valve 20. Specifically, in the illustrated embodiment, the end wall 80 blocks the carrier passage 56 while the side wall 70 blocks the chemical and vent passages 42, 46. The sealing members 92, 95 form a tight seal to prevent leakage between the valve 20 and the inner bore 22.

Figure 9:
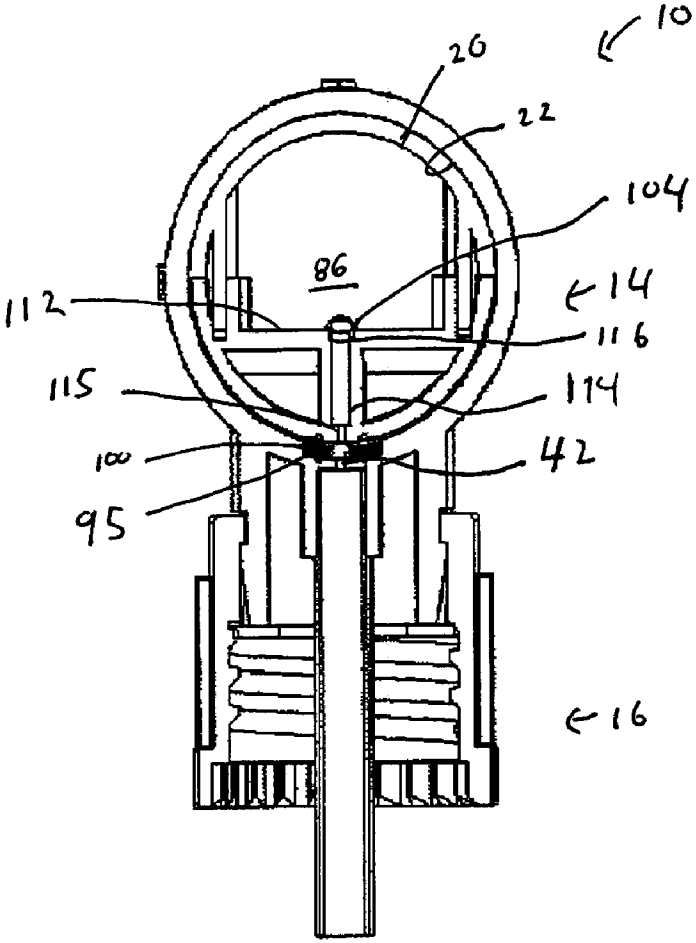
FIG. 9 is a cross-sectional view of the sprayer head assembly taken through line 9-9 of FIG. 8.
Figure 10:
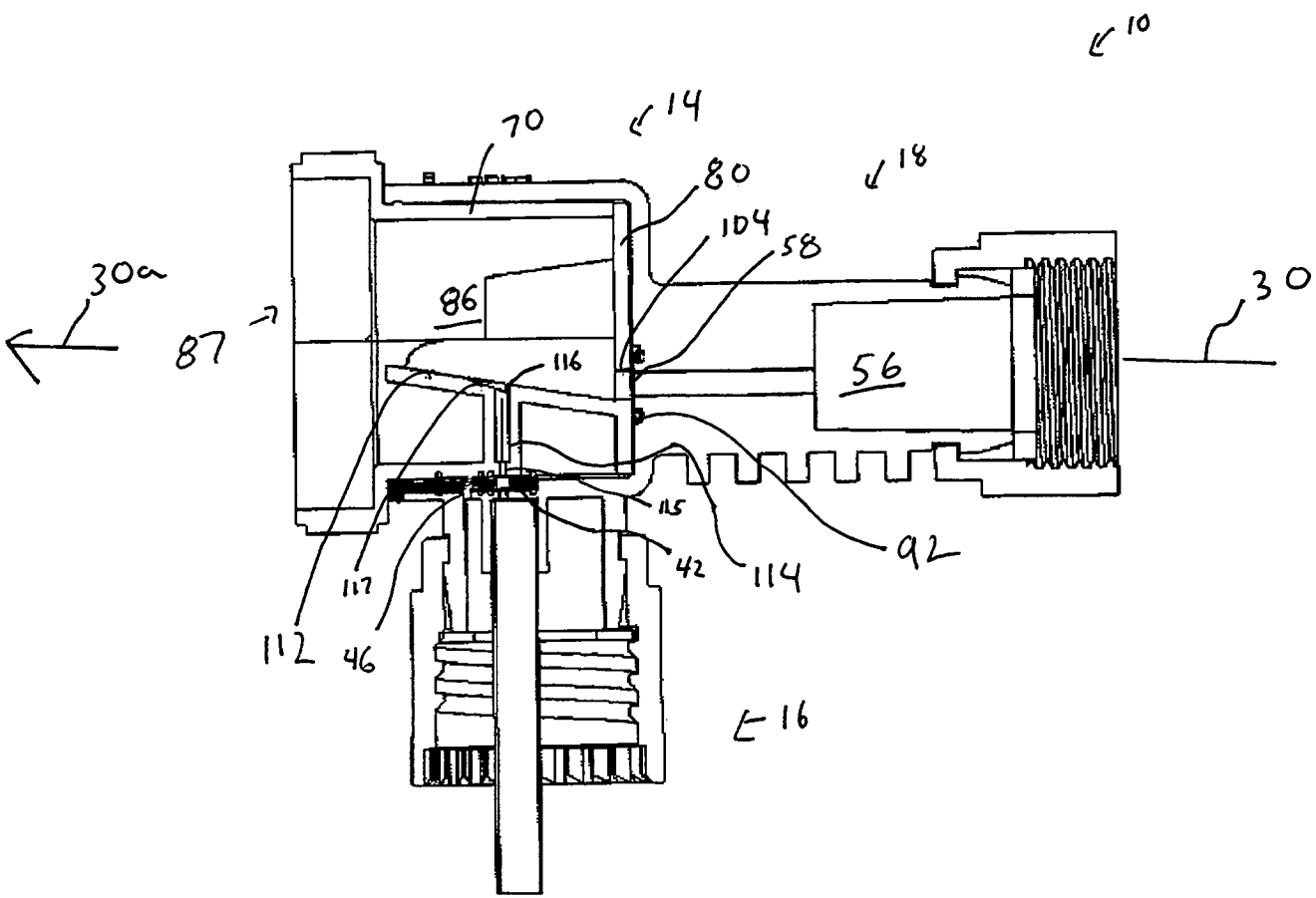
FIG. 10 is a cross-sectional side view of the sprayer head assembly of FIG. 8 in the "on" position.
Figure 13:
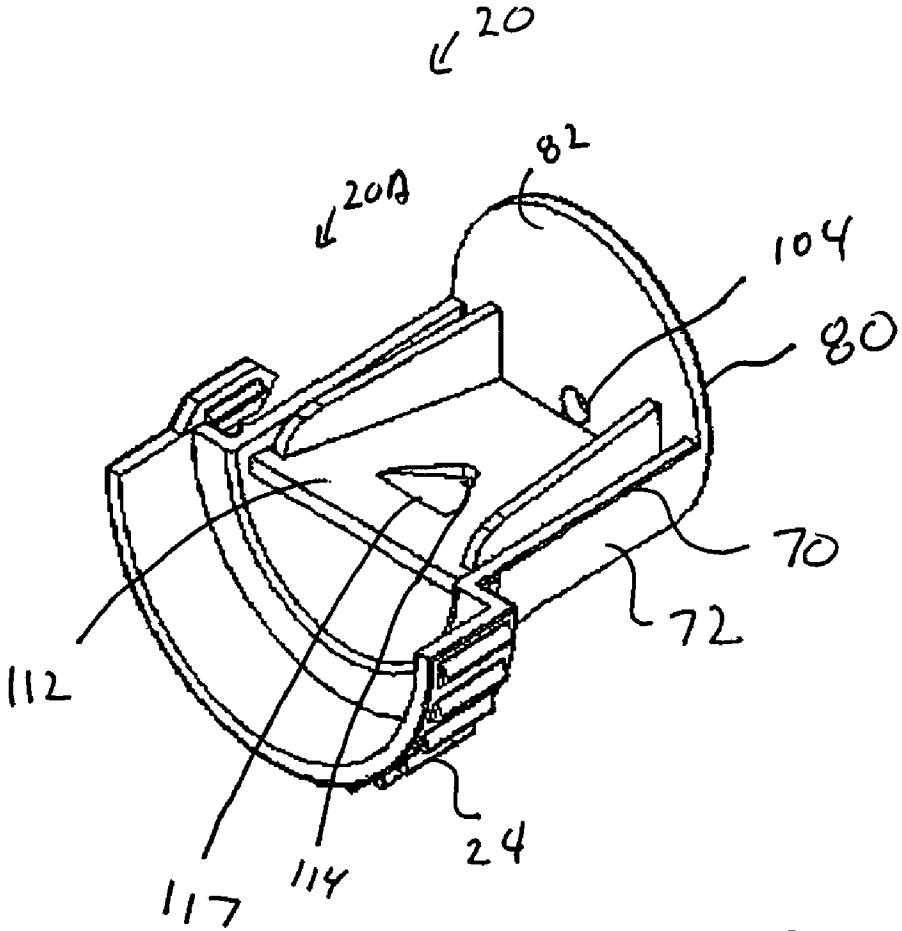
FIG. 13 is a top perspective view of a bottom half of the valve of the sprayer head assembly of FIG. 1.

With reference now to FIGS. 9-11, the valve 20 in shown in a "chemical" or "on" position. As shown, the valve 20 defines a first passage 86, which in the illustrated embodiment is defined in part by a first opening 104 in the proximal end wall 80 of the valve (see also FIGS. 13-15). The first passage 86 is configured and positioned within the valve 20 such that when the valve 20 is the on position the first passage 86 is in communication with the supply fluid passage 56. In the illustrated embodiment, the first passage 86 is placed in communication with the supply passage 56 by aligning the first opening 104 with the opening 58 of the supply passage 56. The first passage 86 is defined generally between the side wall 70 and a valve surface 112, which is also shown in FIGS. 13 and 15.

The valve 20 also defines a chemical inlet passage 114, which is configured and positioned within the valve 20 such that when the valve 20 is the chemical position, the chemical inlet passage 114 is aligned with and communicates with the chemical passage 42. As illustrated in FIGS. 9 and 10, the interface between the chemical inlet passage 114 and the chemical passage 42 is sealed by the sealing member 95 as described above.

The chemical inlet passage 114 defines a metering orifice 115 and terminates at an opening 116, which is preferably positioned in a graduated recess 117 formed on the valve surface 112. As carrier fluid flows through the second passage 86 and over the valve surface 112 and graduated recess 117, a suction force is created which draws the chemical from the container through the chemical passage 42 and into the second passage 86 where it is mixed with the carrier fluid and discharged from the assembly. Thus, in the illustrated embodiment, the second passage 86 forms, at least in part, an outlet 87 of the assembly 10. As shown in FIG. 10, the outlet 87 is defined generally by the distal end 26 of the valve 20.

As is known in the art, the diameter of the metering orifice 115 in the illustrated embodiment) and the opening 116 determines, for the most part, the dilution ratio of the sprayer head assembly 10. The method for determining the diameter of the metering orifice 115 and mouth 116 to achieve a desired dilution ratio are well known to those of ordinary skill in the art; therefore, a detailed description of such a method is not necessary.

Figure 14:
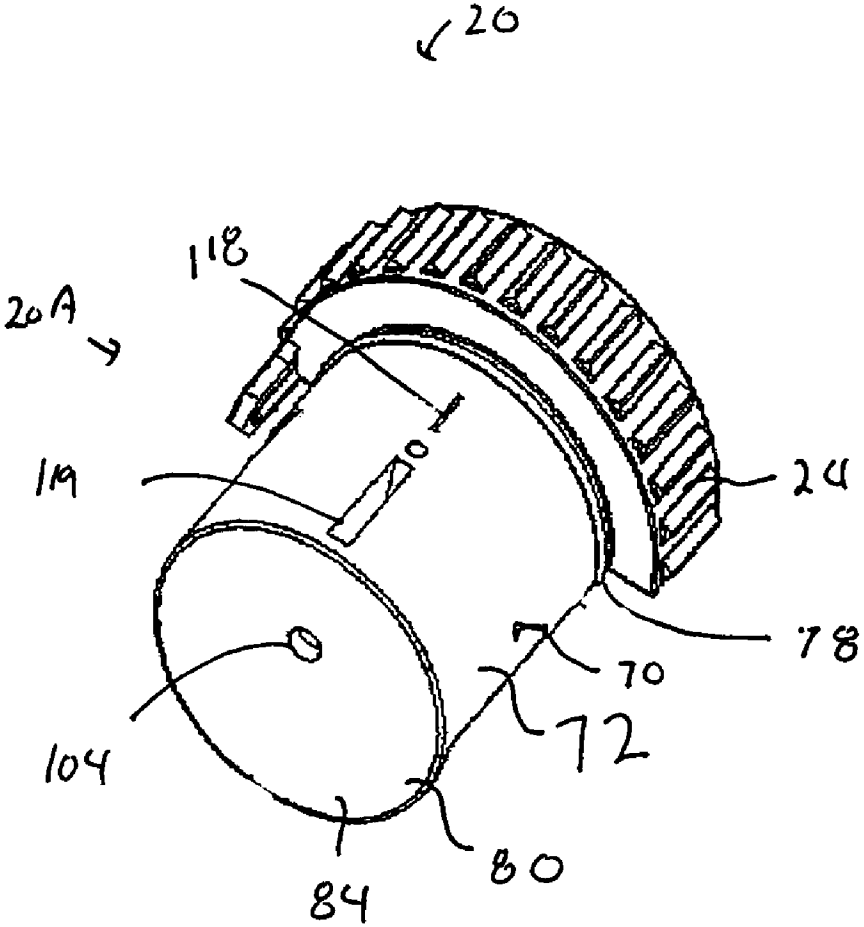
FIG. 14 is a bottom view of the portion of the valve shown in FIG. 13.
Figure 15:
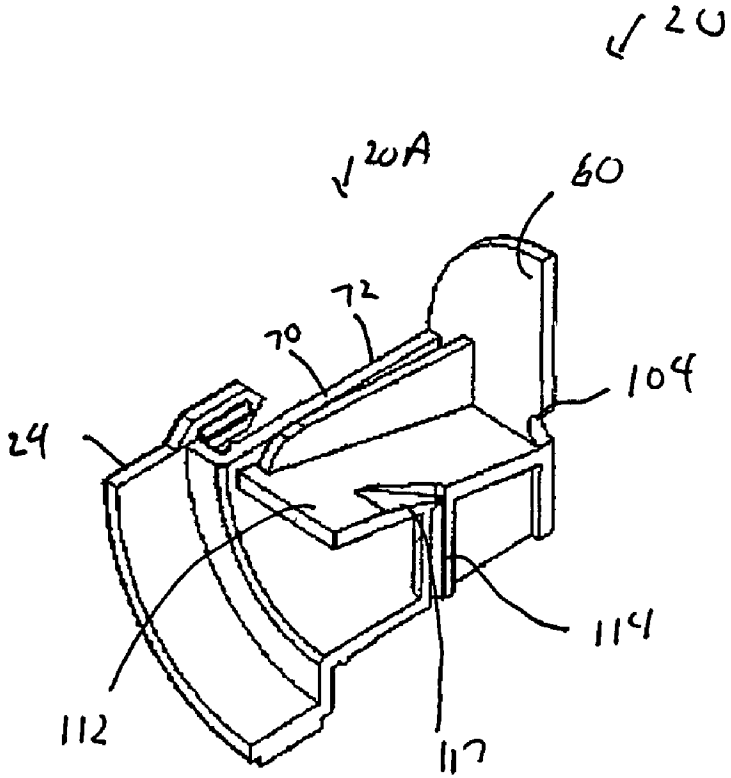
FIG. 15 is a cross-sectional perspective view of the portion of the valve shown in FIG. 13.
Figure 16:
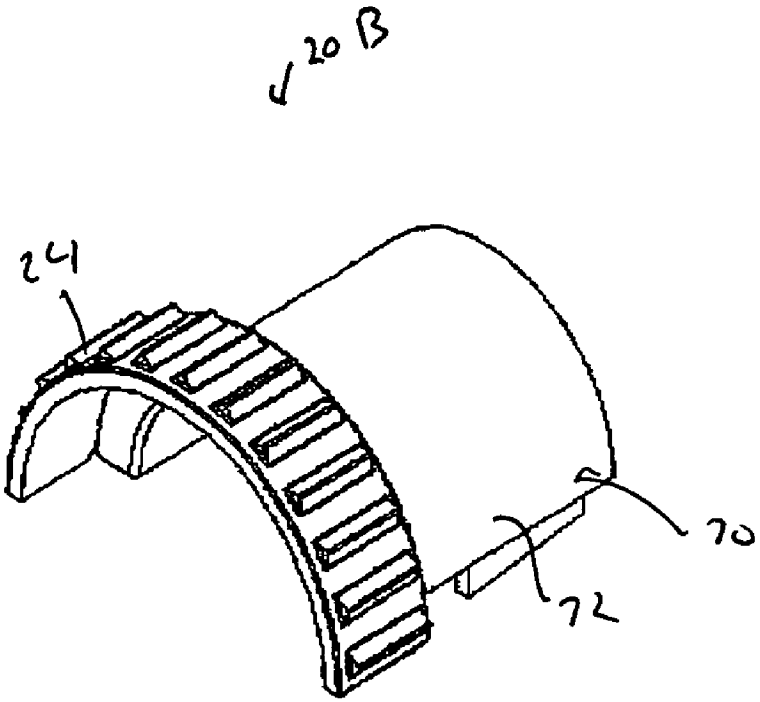
FIG. 16 is a top view of a top half of the valve of the sprayer head assembly of FIG. 1.
Figure 17:
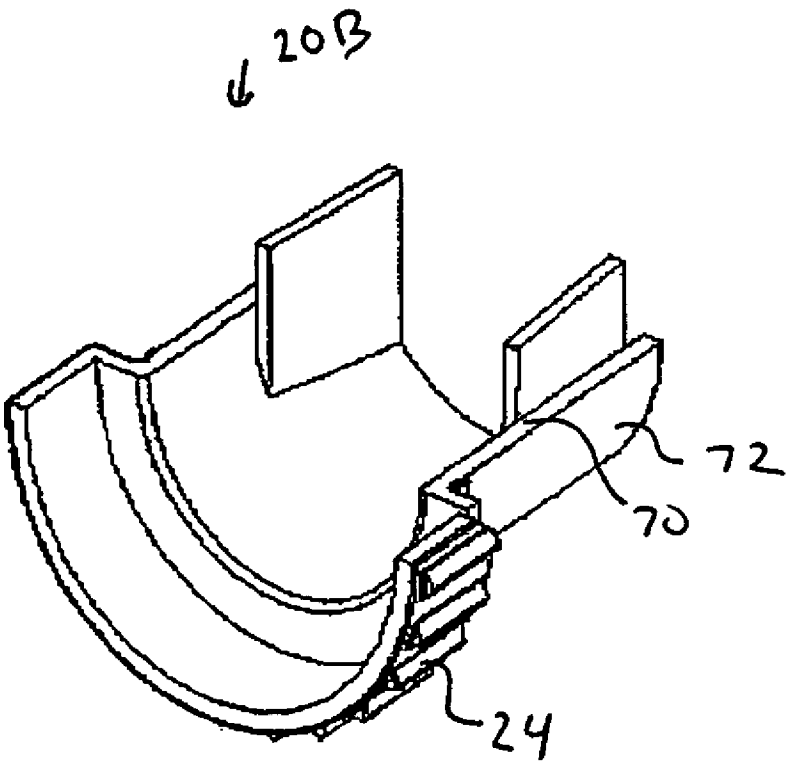
FIG. 17 is a bottom view of the portion of the valve shown in FIG. 16.

With reference to FIG. 14, the valve 20 includes a channel 118. When the valve 20 is at the chemical position, the channel 118 is aligned with the vent passage 46. The channel 118 extends beyond the ridge 204 of the sealing member 95. In this manner, the vent passage 46 is placed in communication with an atmospheric pressure source through the gaps formed between the valve 20 and the inner bore 22. In the illustrated embodiment, the channel 118 extends to the distal end of the valve 20. The valve 20 may also include various cutouts 119 to facilitate fabrication by injection molding or reduce material costs.

With reference to FIG. 10, the carrier fluid sealing member 92 forms an annular seal around the interface between the carrier fluid passage 56 and the first opening 104. Accordingly, the connection between the carrier fluid passage 56 and the first passage 86 is sealed and supply fluid is prevented from leaking into the gaps between the valve 20 and the cylindrical bore 22. As described above, the carrier fluid sealing member 92 may be formed by the sealing member (e.g., an 0-ring) positioned on the wall 60 (see e.g. FIG. 12 of the illustrated embodiment) or in other embodiments on the valve 20 itself.

In the chemical on position (see FIG. 10), a stream of pressurized carrier fluid is discharged into the first passage 86. As the carrier fluid flows over the valve surface 112 and recess 117, a suction force is created that draws chemical through the dip tube 40, the chemical passage 42, the chemical inlet passage 114 and into the stream of carrier fluid. Venting is provided through the vent passage 46 and the channel 118. The chemical/carrier fluid mixture is discharged through the valve 20.

FIGS. 21-26 illustrate a modified embodiment of a sprayer assembly 10", which includes a third position configured to provide only carrier fluid. This embodiment is similar to the embodiments described above. Accordingly, the same reference numbers will be used to designate parts and components substantially similar to the embodiments described above.

Figure 27:
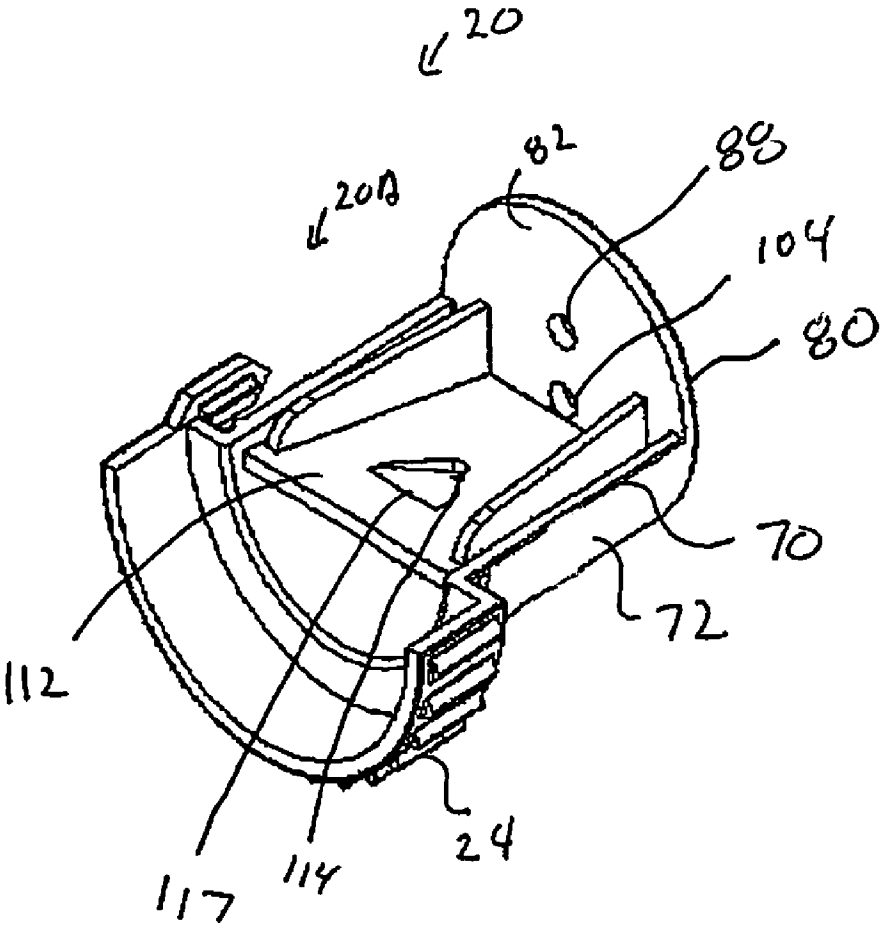
FIG. 27 is a top perspective view of a bottom half of the valve of the sprayer head assembly of FIG. 21.
Figure 28:
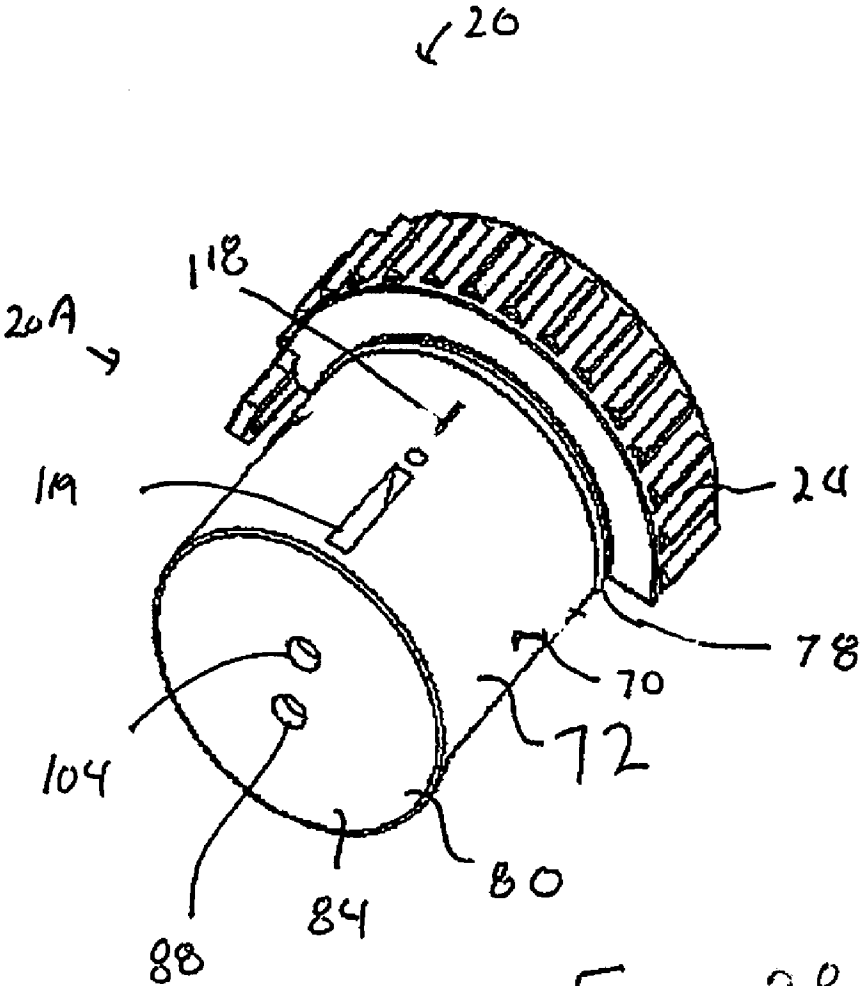

In this embodiment, the valve 20 defines at least in part a second opening 88 (see also FIGS. 27-28), which is formed in the proximal wall 80 of the valve 20. The second opening 88 is configured and positioned within the valve 20 such that when the valve 20 is a "water" or "carrier fluid only" position (i.e., the position shown in FIGS. 21-26) the second opening 88 is in communication with the carrier fluid passage 56. Specifically, in the illustrated embodiment, the second opening 88 is aligned with the carrier fluid passage 56 through the opening 58. In the manner, carrier fluid can flow through the second opening 88 and into the first passage 86 and then discharged from the assembly 10" through the valve 20. As described above, the sealing member 92 provides a seal between the valve 20 and the inner bore 22.

With continued reference to FIGS. 21-26, in the water or carrier fluid only position, the side wall 70 of the valve 20, blocks the chemical passage 42 and the sealing member 95 forms a tight seal between the valve 20 and the inner bore 22. The side wall 70 of the valve 20 preferably also blocks the vent passage 46 and the sealing member 95 also forms a tight seal to prevent leakage form the vent passage 46 into the inner bore 22.

In the water position (see FIG. 24), a stream of pressurized carrier fluid is discharged from the second opening 88 and is not mixed with the chemical because the chemical passage 42 and the vent passage 46 are blocked by the valve 20. In this manner, only carrier fluid is discharged from the assembly 10" through the first passage 86. In certain applications, the water position may be used to rinse chemical that has been applied using the on position of the assembly.

The sprayer assembly preferably includes visual indicia to indicate the position of the valve. With respect to the embodiment of FIGS. 1-11, the visual indicia 124 comprises the words "OFF" and "ON", which are placed on the housing 14. The valve 20 includes a tab 126, which for each of these positions points to the appropriate visual indicia 124 on the housing. With respect to the embodiment of FIGS. 21-26, the visual indicia 124 comprises the words "OFF", "WATER" and "ON".

The illustrated embodiments described above are particularly adapted to be manufactured by injection molding. Because the assembly will typically be discarded after the chemical in the container is exhausted, the costs of manufacturing the assembly must be low. Injection molding is a particularly low cost method of making parts out of plastic-type materials. Those of ordinary skill in the art will recognize that the sprayer head 14, the container connection portion 16, the supply fluid connection portion 18, the sealing member 94 and the rotatable control valve 20 can all be formed using injection molding.

To further reduce the cost of an aspirator-type sprayer; it is beneficial to use a minimum number of parts. The illustrate embodiments preferably includes only four main parts: the head 14, the control valve 20, and the sealing members 92, 95. This represents a great improvement over sprayers that include a plurality of valves, multiple 0-rings and multiple sealing members. Additionally, these parts may be relatively small using less plastic and smaller molds, further decreasing costs. Furthermore, the illustrated assembly 10 is easily assembled. The two main assembling steps are (i) placing the sealing members 92, 95 into the recesses on the inner bore 22 and (ii) snap-fitting the valve 20 into the valve chamber 22.

Because of safety concerns, it is preferable that an aspiration-type sprayer not leak. One of ordinary skill in the art will appreciate that the illustrated assembly 10 described above meets this requirement.

Although this invention has been disclosed in the context of certain preferred embodiments and examples, it will be understood by those skilled in the art that the present invention extends beyond the specifically disclosed embodiments to other alternative embodiments, combinations, sub-combinations and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A sprayer head assembly for connection to a container that defines a cavity for storing a chemical to be sprayed, the sprayer head assembly comprising:

a sprayer head;

a cylindrical valve chamber comprising a valve chamber end wall, the valve chamber end wall having a single opening;

a chemical passage that is configured to be in communication with the cavity and in communication with the valve chamber;

a vent passage that is configured to be in communication with the cavity and in communication with the valve chamber;

a carrier fluid passage that is configured to be in communication with a carrier fluid source and in communication with the valve chamber through the single opening; and a valve moveably positioned within the valve chamber between at least a first position and a second position, the valve comprising:

a first passage and a chemical inlet passage in communication with the first passage, the valve being configured such that, in the first position, the valve blocks the vent passage, chemical passage and carrier fluid passage, in the second position, the first passage is configured to be in communication with the carrier fluid passage while the chemical passage is in communication with the chemical inlet passage;

a proximal end wall including an outer surface and an inner surface, the proximal end wall having a first opening that, in the second position, is in communication with the single opening in the valve chamber end wall; and a suction generating recess positioned within the first passage, the chemical inlet passage communicating with the first passage through an opening positioned within the suction generating recess and wherein the first passage defines an outlet for discharging a carrier fluid and chemical in a first direction and wherein the valve is rotatable about an axis that is generally parallel to the first direction.

2. The sprayer head assembly as in claim 1, wherein the valve has a third position in which the first passage is configured to be in communication with the carrier fluid passage and the chemical inlet passage is configured to not be in communication with the chemical passage.

3. The sprayer head assembly as in claim 2, wherein the valve includes a second opening that in the third position is aligned with an outlet of the carrier fluid passage to place the carrier fluid passage in communication with the first passage.

4. The sprayer head assembly as in claim 1, wherein the chemical inlet passage includes a metering orifice.

5. The sprayer head assembly as in claim 1, wherein the sprayer head includes a retention structure which is configured to engage a corresponding retention structure on the valve in a snap fit.

6. The sprayer head assembly as in claim 5, wherein the retention structure comprises an annular ridge on the valve which engages a annular recess on the valve chamber.

7. The sprayer head assembly as in claim 5, wherein the retention structure is an annular ridge on an outer surface of the sprayer head which engages one or more tabs of the valve which extends over a portion of the outer surface.

8. The sprayer head assembly as in claim 1, comprising a first sealing member configured to provide a seal between the carrier fluid passage and the valve chamber.

9. The sprayer head assembly as in claim 8 wherein the first sealing member is positioned within a recess formed in the valve chamber.

10. The sprayer head assembly as in claim 9, wherein the first sealing member forms an annular ring that generally surrounds an outlet of the carrier fluid passage.

11. The sprayer head assembly as in claim 8, further comprising a second sealing member configured to provide a seal between the chemical inlet passage and the valve chamber.

12. The sprayer head assembly as in claim 11, wherein the second sealing member is positioned within a second recess on the valve chamber.

13. A sprayer head assembly for connection to a container that defines a cavity for storing a chemical to be sprayed, the sprayer head assembly comprising:

a sprayer head comprising:

a chemical passage that is configured to be in communication with the cavity, a carrier fluid passage that is configured to be in communication with a carrier fluid source, a vent passage that is configured to be in communication with the cavity;

a generally cylindrical valve chamber that is in communication with the chemical passage, vent passage, and carrier fluid passage; and a valve moveably positioned within the valve chamber between at least a first position and a second position, the valve comprising:

a first passage and a chemical inlet passage in communication with the first passage, the valve being configured such that, in the first position, the valve blocks the vent passage, chemical passage and carrier fluid passage, in the second position, the first passage is configured to be in communication with the carrier fluid passage while the chemical passage is in communication with the chemical inlet passage;

wherein the valve further comprises a suction generating recess positioned within the first passage, the chemical inlet passage communicating with the first passage through an opening positioned within the suction generating recess and wherein the first passage defines an outlet for discharging a carrier fluid and chemical in a first direction and wherein the valve is rotatable about an axis that is generally parallel to the first direction, and a retention structure which is configured to engage a corresponding retention structure on the valve in a snap fit.

14. The sprayer head assembly of claim 13, wherein the retention structure comprises an annular ridge on the valve which engages an annular recess on the valve chamber.

15. The sprayer head assembly as in claim 13, wherein the retention structure is an annular ridge on an outer surface of the sprayer head which engages one or more tabs of the valve which extends over a portion of the outer surface.

16. The sprayer head assembly as in claim 13, wherein the valve includes a first opening that in the second position is aligned with an outlet of the carrier fluid passage to place the carrier fluid passage in communication with the first passage.

17. The sprayer head assembly as in claim 13, wherein the valve has a third position in which the first passage is configured to be in communication with the carrier fluid passage and the chemical inlet passage is configured to not be in communication with the chemical passage.

18. A sprayer head assembly, comprising:

a sprayer head, comprising:

a chemical passage;

a carrier fluid passage;

a vent passage;

a valve chamber that is in communication with the chemical passage, vent passage, and carrier fluid passage; and a recess in the valve chamber;

a sealing member positioned in the recess; and a valve positioned within the valve chamber and moveable between at least a first position and a second position, the valve comprising:

a first passage defining an outlet in a first direction;

a suction generating recess positioned in the first passage;

an opening in the suction generating recess;

a chemical inlet passage in communication with the first passage through the opening; and wherein the valve is rotatable about an axis that is generally parallel to the first direction and the valve blocks the vent passage, chemical passage and carrier fluid passage in the first position and in the second position, the first passage is in communication with the carrier fluid passage and the chemical passage is in communication with the chemical inlet passage.

19. The sprayer head assembly of claim 18, wherein the sealing member forms an annular ring that generally surrounds an outlet of the carrier fluid passage.

20. The sprayer head assembly of claim 18, further comprising a second sealing member between the chemical inlet passage and the valve chamber.

* * * * *